United States Patent [19]

Croucher et al.

[11] Patent Number: 4,816,370

[45] Date of Patent: Mar. 28, 1989

[54] DEVELOPER COMPOSITIONS WITH STABILIZERS TO ENABLE FLOCCULATION

[75] Inventors: Melvin D. Croucher, Oakville; Raymond W. Wong, Mississauga; Michael L. Hair, Oakville, all of Canada

[73] Assignee: Xerox Corporation, Stamford, Conn.

[21] Appl. No.: 88,361

[22] Filed: Aug. 24, 1987

[51] Int. Cl.[4] ..... G03G 9/12

[52] U.S. Cl. ..... 430/115; 430/137

[58] Field of Search ..... 430/115

[56] References Cited

U.S. PATENT DOCUMENTS

| | | | |
|---|---|---|---|
| 3,900,412 | 8/1975 | Kosel | 430/115 X |
| 3,993,483 | 11/1976 | Maki et al. | 430/115 X |
| 3,998,746 | 12/1976 | Tsureda | 430/114 |
| 4,306,009 | 12/1981 | Veillette et al. | 430/115 |
| 4,425,418 | 1/1984 | Iwaki et al. | 430/115 X |
| 4,454,215 | 6/1984 | Landa | 430/115 |
| 4,476,210 | 10/1984 | Croucher et al. | 430/114 |
| 4,526,852 | 7/1985 | Herrmann et al. | 430/115 |
| 4,582,774 | 4/1986 | Landa | 430/126 |
| 4,690,881 | 9/1987 | Nagai | 430/115 X |
| 4,702,984 | 10/1987 | El-Sayed et al. | 430/115 |
| 4,707,429 | 11/1987 | Trout | 430/115 |

FOREIGN PATENT DOCUMENTS

| | | | |
|---|---|---|---|
| 55-164853 | 12/1980 | Japan | 430/115 |
| 1502794 | 3/1978 | United Kingdom | 430/115 |

*Primary Examiner*—Roland E. Martin

*Attorney, Agent, or Firm*—E. O. Palazzo

[57] ABSTRACT

A liquid developer composition comprised of an oil base, dyed polymer particles, charge control additives, and stabilizers that enable the flocculation of the composition, which stabilizers possess a solubility temperature equal to or exceeding 40° C.

29 Claims, No Drawings

DEVELOPER COMPOSITIONS WITH STABILIZERS TO ENABLE FLOCCULATION

BACKGROUND OF THE INVENTION

This invention is generally directed to liquid developer compositions, especially liquid developers with superior transfer efficiency, especially when, for example, transferring a toned electrostatic image from a photoreceptor to a substrate such as paper. More specifically, the present invention is directed to liquid developer compositions comprised of an oil base, black or colored polymer particles, charge control additives, and a stabilizer/flocculation component. Thus, in one important embodiment of the present invention there are provided liquid ink compositions with excellent transfer efficiencies exceeding 80 percent (percent by weight of the ink composition developed on the photoreceptor and transferred, for example, to paper) or greater, which inks are comprised of an oil base such as, Isopar, dyed polymer particles, charge control additives, and stabilizers, such as poly(ethylene-co-vinyl acetate) copolymers thereby enabling colloidally stable ink particles with a diameter of from about 0.1 micron to about 1.0 micron, which inks can be prepared in situ at temperatures exceeding 65° C. In a further embodiment of the present invention, there are provided liquid ink compositions comprised of an oil component of, for example, Isopar, dyed polymer particles containing black or colored dyes, such as cyan, magenta or yellow; a charge control additive; and for the primary purpose of permitting flocculation of the particles at ambient temperatures a stabilizer/flocculation component, such as a poly(ethylene-co-vinyl acetate) copolymer, which enables transfer efficiencies of greater than 80 percent when transferring an electrostatic image from a photoreceptor imaging member to paper or transparent film. The liquid inks of the present invention can be selected for the development of images in various processes, inclusive of xerographic processes, electrostatic printing, and facsimile systems; color proofing processes; and the process as illustrated in Savin British Patent Publication No. 2,169,416, published July 9, 1986, the disclosure of which is totally incorporated herein by reference.

Development of electrostatic latent images with liquid developer compositions comprised of, for example, a dispersion of pigments in a liquid hydrocarbon are known. In these methods, the electrostatic latent image, which is usually formulated on a photoconductive member, is transported through a bath of the aforementioned liquid developer. Contact with the liquid developer causes the charged pigment particles present therein to migrate through the liquid to the photoreceptor surface in the configuration of a charged image. Thereafter, the toned electrostatic image is then electrostatically transferred from the photoconductor surface to plain paper. The image transfer efficiency from the photoreceptor to the paper is typically about 50 to 60 percent since the phenomenon of ink splitting between the photoreceptor and the paper usually occurs. In this process, the excess liquid toner remaining on the photoreceptor has to be cleaned therefrom prior to the next image cycle, and the excess toner discarded. Also, as only about 50 to 60 percent of the liquid toner is transferred to paper, the optical density of the image is often unacceptably low. Further, liquid toners exhibiting transfer efficiencies greater than about 80 percent also provide dense black images of optical density greater than 1.2, thus minimizing the amount of toner that has to be discarded and rendering an effective cleaning of the photoreceptor surface. The thin film of residual developer remaining on the surface of the sheet is then evaporated within a relatively short time period, usually less than 5 seconds. Also, the marking pigment particles may be fixed to the sheet by heat, for example, in image configuration.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include U.S. Pat. Nos. 3,623,986; 3,625,897; 3,976,583; 4,081,391 and 3,900,412. In the U.S. Pat. No. 3,900,412, there is specifically disclosed a stable developer comprised of a polymer core with a steric barrier attached to the surface of the polymer selected. In column 15 of this patent, there are disclosed colored liquid developers by selecting pigments or dyes, and physically dispersing them by ball milling or high shear mixing. Attempts to obtain color liquid developer compositions by the ball milling process described have been unsuccessful, particularly with respect to obtaining developed images of acceptable optical density in that, for example, the desired size for the latex particles is from 0.2 to 0.3 micron in diameter; and with ball milling techniques it is very difficult to provide a dispersion of carbon black or other pigment particles much smaller in size than about 0.7 to about 0.8 micron. Consequently, the addition of carbon black pigment particles, for example to latex particles with a diameter of 0.2 to 0.3 micron, result after ball milling in relatively small latex particles residing on the surface of the pigment particles.

Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. The history and evolution of liquid developers is provided in the U.S. Pat. No. 4,476,210, reference columns 1 and 2 thereof.

With further regard to the British Patent Publication No. 2,169,416, the disclosure of which is totally incorporated herein by reference, there are illustrated liquid developer compositions comprised of toner particles associated with a pigment dispersed in a nonpolar liquid, and wherein the toner particles are formulated with a plurality of fibers or tendrils from a thermoplastic polymer, and possess a charge of polarity opposite to the polarity of the latent image. These toners apparently permit in some instances excellent transfer efficiencies, however, they have been found to be difficult to prepare, for example, with the aforementioned process batch-to-batch products are dissimilar. Also, the time needed to prepare such particles is about 30 hours, which is uneconomical. Furthermore, since the preferred resin, for example Elvax II 5720, is Isopar insoluble, it entraps Isopar during the mechanical grinding process. Consequently, during the fusing step energy has to be expended in exiting Isopar from the resin as well as fixing it to the paper surface. Accordingly, this results in an energy inefficient liquid toner. Furthermore, the toner particles of the British publication are of from about 2 to 2 microns in size. Ideally, variation and control of the particle size is an important consideration in liquid toner technology. Also, in some instances, the resulting inks do not permit acceptable transfer of the image.

Furthermore, there is illustrated in copending application U.S. Ser. No. 846,164, the disclosure of which is totally incorporated herein by reference, stable black liquid developers comprised of an insulating liquid medium having dispersed therein black marking particles comprised of a thermoplastic resin core which is substantially insoluble in the dispersion medium, and chemically or physically anchored to the resin core an amphipathic block or graph copolymer steric stabilizer which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium. Furthermore, in copending application U.S. Pat. No. 4,762,764, the disclosure of which is totally incorporated herein by reference, there is illustrated dyed sterically stabilized polymer particle for incorporation into negatively charged electrophoretic liquid developers.

The aforementioned liquid developers contain dyed sterically stabilized polymer particles, which are designed primarily for printing onto dielectric papers rather than for accomplishing the development of images present on a photoreceptor, and subsequently transferring the image to plain paper. With these inks and other prior art inks, it has been indicated that the particles are colloidally stable, thus when these particles are in close proximity there is a tendency for them to separate because of repulsive interactions thereby permitting the inks to undesirably readily split between the photoreceptor surface and the substrate surface during the transfer step. The aforementioned problem is eliminated with the inks of the present application by rendering these inks flocculated, thus the forces between the ink particles are attractive rather than repulsive, and the resulting inks cannot be as readily split when being transferred to paper. Accordingly, with the inks of the present invention there are provided excellent transfer efficiencies, and acceptable edge acuity for the final images. Moreover, the aforementioned inks are prepared in a manner to enable the sterically stabilized polymer particles selected to possess stability when formed, which particles subsequently flocculate upon cooling to ambient temperature enabling images of high resolution and wherein the transfer efficiency exceeds, for example, 80 percent to substrates such as paper.

Other prior art of interest includes U.S. Pat. Nos. 4,454,215 and 4,582,774 directed to liquid developers, and more specifically suitable toner particles present in a specific liquid carrier so as to form readily disassociated flocs, reference column 4, lines 63 to 68, and continuing on to column 5, lines 1 to 14. Patents primarily of background interest are U.S. Pat. Nos. 4,306,009; 4,363,863; 4,374,918 and 4,521,505.

Although the above described liquid inks are suitable for their intended purposes, there remains a need for new liquid developers. More specifically, there is a need for liquid developers with superior transfer efficiencies. There also is a need for colored liquid developers which possess the aforementioned characteristics. Additionally, there is a need for economical liquid developer compositions that permit images of excellent resolution in a number of known imaging processes. Moreover, there is a need for liquid developers wherein the colorants selected are suitably dispersed such that the primary particles are submicron in size, preferably an average diameter of 0.2 to 8 microns, thus enabling black or colored images of excellent resolution. Further, there remains a need for liquid developers wherein there is included therein certain stabilizers that enable flocculation of the developer at ambient temperature.

SUMMARY OF THE INVENTION

It is an object of the present invention to provide improved liquid developer compositions.

In another object of the present invention there are provided black and colored liquid developer compositions, which can be selected for use in several different imaging systems.

In yet another object of the present invention there are provided liquid developer compositions with superior transfer efficiencies.

It is an additional object of the present invention to provide liquid developer compositions with transfer efficiencies of 80 percent or greater.

Furthermore, in another object of the present invention there are provided liquid developer compositions with black, cyan, magenta or yellow colors, and mixtures thereof.

Additionally, in another object of the present invention there are provided ink compositions with extended shelf life, and wherein these inks are free of environmental hazards.

In addition, in another object of the present invention there are provided ink compositions that can be readily cleaned from photoreceptor surfaces, especially since less ink is present on these surfaces subsequent to transfer, and wherein the inks can be dried by the evaporation of the oils contained therein with heating or fusing.

Moreover, there is a need for ink compositions that are useful in various development systems, inclusive of electrostatic printing, color proofing methods, and the like.

In addition, there is a need for ink compositions possessing a primary particle size average diameter of from about 0.2 micron to about 0.8 micron, which inks are flocculated at ambient temperatures, and wherein the floc sizes of the inks are preferably from about 2 to about 8 microns.

These and other objects of the present invention are acocmplished by providing liquid toner compositions. More specifically, in one embodiment the present invention is directed to liquid developer compositions with transfer efficiencies of 80 percent or greater comprised of an oil base core component of, for example, Isopar L, dyed polymer particles, charge control additives, and a stabilizer component, that assists in the desired flocculation of the polymer toner composition components, which stabilizer possesses a solubility temperature equal to or exceeding 40° C. In one specific embodiment of the present invention, there are provided liquid developer compositions comprised of from about 90 percent to about 99.5 percent by weight of an oil base component illustrated herein, from about 0.5 percent to about 6 percent by weight of black, or colored dyed polymer particles, from about 0.01 to about 2 percent by weight of charge control additives, and from about 0.5 to about 4 percent by weight of stabilizers, inclusive of poly-(ethylene-co-vinyl acetate) copolymers, which are physically or chemically attached to the dyes polymer core particle.

Examples of oil base vehicle components present in an amount of from about 90 percent by weight to about 99.5 percent by weight, and preferably present in an amount of from about 96 percent by weight to about 99.5 percent by weight, include aliphatic hydrocarbons, such as Isopar G, L, M, commercially available from Exxon Corporation. Other oil base examples include Amsco 450 solvent and Amsco OMS, both available from American Mineral Spirits Company; mineral spirits such as Soltrol, available from Phillips Petroleum; Pegasol, available from Mobil Oil; and aliphatic hydrocarbon liquids such as Shellsol, available from Shell Oil.

Dyed polymer particles present in an amount of from about 0.5 percent by weight to about 6 percent by weight, and preferably present in an amount of from about 0.6 percent by weight to about 2 percent by weight are selected. Illustrative examples of the polymer component which are insoluble in the oil base such as Isopar include poly(methyl acrylate), poly(methyl methacrylate), poly(ethyl methacrylate, poly(hydroxyethyl methacrylate), poly(2-ethoxyethyl methacrylate), poly(butoxy ethoxyethyl methacrylate), poly(-butoxy ethoxyethyl methacrylates), poly(dimethyl amino ethyl acrylates), poly(acrylic acids), poly(methyacrylic acids), poly(acrylamides), poly(methacrylamides), poly(acrylonitriles), poly(vinyl chlorides), and poly(ureido-ethyl vinyl ethers). A preferred group of materials are the homopolymers of vinyl acetate, N-vinyl-2-pyrrolidone, ethyl acrylate, and copolymers thereof. Thermoplastic resins selected from the group consisting of vinyl, acrylic and methacrylic resins are preferred resins for the core of the marking particles. The mechanical properties of the marking particle may be altered or varied by the selection of the polymer used for the core of the particle. For transfer liquid toners, the mechanical properties of the particle are important since it is preferred that the particles retain their spherical shape, thus for example preventing formation of a film on the photoreceptor. Consequently, the core of the polymer particle should have a glass transition temperature greater than about 35° C.

The polymeric marking particle may be treated with an suitable organic dye to impart color to it. Generally, the organic dye is preferably dispersible at the molecular level in the synthetic resin core to provide a molecular dispersion and ensure distribution thereof since it would otherwise tend to aggregate and provide poor color intensity as well as broadened spectral characteristics. Furthermore, the organic dye should be insoluble in the carrier liquid, thus once it is imbibed into the resin core it will not diffuse out into the dispersion medium. In addition, insolubility in the dispersion medium ensures that the background deposits will be minimized as the entire imaging surface can be contacted with the liquid developer during development of the electrostatic latent image, and the dye cannot deposit on the background areas of the imaging surface when it is insoluble in the liquid phase. Moreover, it is preferred that the dye be water insoluble to ensure permanence of the developed image and to avoid dissolving subsequent to development should the image come into contact with water, coffee, tea and the like. Typical organic dyes that may be selected include Orasol Blue GN, Orasol Red 2BL, Orasol Blue BLN, Orasol Black GN, Orasol Black RL, Orasol Yellow 2RLN, Orasol Red 2B, Orasol Blue 2GLN, Orasol Yellow 2GLN, Orasol Red G, available from Ciba Geigy, Mississauga, Ontario, Canada; Morfast Blue 100, Morfast Red 101, Morfast Red 104, Morfast Yellow 102, Morfast Black 101, available from Morton Chemical Limited, Ajax, Ontario, Canada; and Savinyl Yellow RLS, Savinyl Yellow 2RLS, Savinyl Pink 6BLS, Savinyl Red 3BLS, Savinyl Red GL5, Savinyl Black RLS, available from Sandoz, Mississauga, Ontario, Canada; and Neozapon Black X57 from BASF, Toronto, Ontario, Canada; and Astrophalozine FF, available from Nachem Inc., United States. Other similar dyes can be selected providing the objectives of the present invention are achieved.

Examples of charge control additives that may be selected for the liquid developer compositions of the present invention, and that are present in an amount of from about 0.01 percent by weight to about 2.0 percent by weight, and preferably in an amount of from about 0.02 percent by weight to about 0.05 percent by weight, are the cadmium, calcium, manganese, magnesium and zinc salts of heptanoic acid; the barium, aluminum, cobalt, manganese, zinc, cerium and zirconium salts of 2-ethyl hexanoic acid (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diiopropyl salicylate, aluminum dresinate, and the aluminum salt of 3,5 di-t-butyl gamma resorcylic acid. Mixtures of these materials may also be used. Preferred charge control additives are zirconium octoate, which is available from Nuodex Canada, polyisobutylene succinimide, commercially available as OLOA 1200 from Chevron Chemical Company, and lecithin, commercially available from Fisher Scientific Company. The aforementioned charge control additive can impart a positive or negative charge to toner composition, which charge is dependent primarily on the interaction of the molecularly dissolved dye and the polymer particles.

The steric stabilizer selected is of importance since, for example, during the particle polymerization process its purpose is to stabilize the growing nuclei of the polymer particle. Accordingly, it becomes irreversibly anchored to the synthetic resin core. Typically, the steric stabilizer is composed of a copolymer, preferably a block or graft copolymer having a moiety with an affinity for, or being solvated by the oil based dispersion medium and having a second moiety with an affinity for the synthetic resin core, and which is nominally insoluble in the oil based dispersion medium. Additionally, the steric stabilizer should be completely soluble in the oil based dispersion medium at temperatures between about 60° and about 90° C. Once the ink particles have been formed, the dispersion is allowed to cool to room temperature. Upon cooling, the particles resulting undergo a stability-instability transition such that the submicron size primary particles aggregate to form loose micron size flocs in dispersion, that is the particles are slightly attracted to one another. It is this mechanism that is believed to provide for the superior ink transfer characteristics. This flocculation process is affected by permitting the steric stabilizer copolymer phase to separate upon cooling. Thus, the stabilizer copolymer selected usually exhibits a constant solubility temperature of 40° C. and above, and preferably between about 45° and 60° C. When this occurs, the steric stabilizer collapses and allows the attractive Van der Waals forces between the particles to become effective causing the dispersion to flocculate. Examples of copolymers that can be selected include poly(ethylene-co-vinyl acetate) copolymers preferably with not more than 30 mole percent of vinyl acetate. The materials of choice are known as Elvax I polymers, and are available from E.I. DuPont Company of Wilmington, Delaware. The steric stabilizer comprises from between 1 and about 10 percent by weight of the polymer particles.

The ink compositions of the present invention are particularly useful in liquid development systems, such as those illustrated in the aforementioned British Patent Publication, and color proofing processes. More specifically, these processes involve depositing an electrostatic charge pattern on a photoreceptor or a dielectric surface, and then toning the electrostatic image with the liquid developer of the present invention, followed by electrostatically transferring to plain paper. In addition, the liquid developer compositions of the present invention are also useful for enabling the development of colored electrostatic latent images, particularly those contained on an imaging member charged positively, or negatively. For a positively charged electrostatic image, a negatively charge liquid developer is selected; while for a negatively charged electrostatic image, a positively charged liquid developer is utilized to obtain a developed image. Examples of imaging members that may be selected are various known organic photoreceptors, including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbazole; 4-dimethylaminobenzylidene; benzhydrazide; 2-benzylidene-amino-carbazole; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinyl carbazole-tritrofluorenone charge transfer complex; and mixtures thereof. Further imaging members that can be selected are selenium and selenium alloys, zinc oxide, cadmium sulfide, hydrogenated amorphous silicon, as well as ionographic surfaces of various dielectric materials, such as polycarbonate polysulfone fluoropolymers, and anodized aluminum alone or filled with wax expanded fluoropolymers.

The liquid developers of the present invention can be prepared by various suitable methods. One process for obtaining the stabilized, highly colored liquid developer compositions of the present invention involves first dissolving the amphipathic stabilizer in the liquid developer dispersion medium at elevated temperatures above about 60° C. An excess of a monomer or mixture of monomers from which the synthetic resin core is to be formed together with a free radical initiator is then added to the stabilizer solution, followed by polymerizing the monomer to form the synthetic resin. Thereafter, a solution of the dye or mixture of dyes in a polar solvent or mixture of polar solvents is added to the dispersion to imbibe the dye in the core of the marking particle.

During the polymerization procedure, the amphipathic steric stabilizer becomes intimately bound to the synthetic core. The expression "intimately bound" is intended to refer to chemical and physical interactions that irreversibly anchor the amphipathic stabilizer in a manner that prevents its separation from the ink particle under normal operating conditions. Once the stabilized resin core has been prepared, the dye may be imbibed in it as described hereinafter, and a charge control agent can then be added to the dispersion. The aforementioned procedure may be viewed as a four step process involving:

(A) dissolution of the amphipathic stabilizer in the oil based dispersion medium;

(B) non-aqueous dispersion polymerization of the core monomer in the presence of the amphipathic stabilizer to provide the stabilized particle;

(C) dyeing of the non-aqueous dispersion particles, and cooling the dispersion to form ink flocs, and;

(D) adding charge control components to assist in providing negatively or positively charged particles.

Once the stabilizer has been dissolved in the dispersion medium, the synthetic resin core can be prepared by a non-aqueous dispersion polymerization method. This is accomplished by adding an excess of a monomer to be polymerized to the solution containing the amphipathic stabilizer, which acts as the steric stabilizer during the growth of the polymer particles. This growth takes place in the presence of a free radical initiator at atmospheric pressure and elevated temperatures of from about 60° C. to about 90° C. Over a period of from about 1 to about 20 hours, the polymer core of the marking particles is grown in the presence of the steric stabilizer with the result that a dispersion is formed containing up to about 50 percent by weight of particles have a relatively uniform size of 0.1 micrometer to about 1 micrometer with most of the particles being in the 0.2 to 0.8 micrometer size range. During the growth of the polymer core, the amphipathic polymer functions as a steric stabilizer to retain the individual growing particles separate in the dispersion. If, for example, the dispersion polymerization of the core monomer takes place without the stabilizer present, the polymer formed from the monomer will phase separate forming the nucleus of the particle which will then flocculate and settle as sediment in the form of an aggregate. Instead, the polymerization takes place in the presence of the stabilizer which becomes irreversibly and intimately bound either chemically or physically to the polymer core being formed thereby providing a thermodynamically stable particle.

Once the stable dispersion of marking particles has been prepared, it is dyed to provide a core particle capable of producing a toned image of acceptable optical density and color characteristics. The dye is molecularly incorporated into the core particles by selecting a specific dye imbibition absorption technique. It has been found that polar solvents may be specifically absorbed into the core of the particle produced from the non-aqueous dispersion polymerization procedure, and by dissolving a dye into such a polar solvent the dye is readily imbibed or absorbed into the polymer core. The polar solvent used should be essentially insoluble in the dispersion medium otherwise some of the dye may be directed into the dispersion medium increasing the possibility of dye deposition in the background areas. Any suitable polar solvent which is absorbed into the core of the marking particle may be employed. It has been found that methanol, glacial acetic acid, ethylene glycol, dimethyl sulfoxide and N,N-dimethyl formamide, and mixtures of these solvents perform well. Methanol is preferred as the solvent for the dye since it can be readily removed by simple heating or distillation under reduced pressure. Other suitable known techniques may be used to remove the polar solvent from the particles.

The dyes selected should be highly soluble in the polar solvent and insoluble in the dispersion medium. Typical dyes selected as indicated herein include, for example, Orasol Blue 2GLN, Orasol Yellow 2GLN, Orasol Red G, Orasol Black RL, and the like. Also, from about 5 percent to about 24 percent, and preferably 10 percent weight/volume solution of the dye is prepared and added dropwise to the dispersion containing from about 2 percent to about 10 percent by weight of marking particles. This imbibition procedure is affected at elevated temperatures of from about 50° C. to about 70° C. until an acceptable amount of dye has been imbibed or absorbed by the core particles. Typically, this can take from about 2 to about 16 hours depending on the dye, the type of core particle, and the temperature employed. By this process, there are formed stable colored marking particles yielding developed or toned images of superior optical density and color characteristics. After the dye imbibition procedure, the dye solvent, particularly if it is methanol, may be removed by distillation thereby imparting somewhat better image properties. The concentrate so prepared may then be diluted to about 0.5 to 6.0 percent by weight of particles by adding more of the oil based dispersion medium for preparing the working ink dispersions. On cooling the dispersion to room temperature, the primary particles form a loose floc which can be readily broken up into primary particles upon shaking.

For the dyed particles to develop a positive or negatively charged electrostatic latent image, they must be charged to a negative or positive charge, respectively. For assisting in this purpose, there is selected a charge control agent which is preferably soluble in the dispersion medium, but must be adsorbed at the particle-fluid interface. Some of the adsorbed charge control agent then disassociates imparting a positive or negative charge to the particle. It is also important that the charge control agent not disassociate in the oil based dispersion medium alone to a large degree since the fluid then becomes too conductive and free ions will discharge the latent image. Optimum results are achieved by the selection as the charge control agents polyisobutene succinimide, lecithin, and zirconium octoate. Typically, from about 0.01 percent to about 5 percent of charge control agent based on the weight of the developer particles plus the fluid is employed. The amount of charge control agent added is dependent upon the charge/mass ratio desired for the liquid developer, which typically can range from less than 10 microcoulombs per gram to greater than about 1,000 microcoulombs per gram. The charge/mass ratio can be controlled by varying the concentration and the type of charge control agent used with a particular latex.

Additionally, the liquid developers of the present invention may comprise various constituents in a variety of suitable proportions depending upon the ultimate end use. While the resulting developers may have a solid content of from about 0.5 to about 6 percent by weight, typically from about 0.5 percent to about 2.0 percent by weight of particles are used in the dispersion medium. Each particle comprises from about 90 percent to about 98 percent by weight of the polymer core, and from about 10 percent to about 2 percent by weight of amphipathic stabilizer. The polymer core typically contains from about 5 percent to about 30 percent by weight of the dye, and the charge control agent is present in amounts of from about 0.1 percent to about 5 percent by weight based on the weight of the particles to provide a charge/mass ratio of from 10 to in excess of 1,000 microcoulombs per gram.

The developer compositions of the present invention possess several advantages over many prior art developers. For example, the polymer particles for the developers of the present invention are prepared by an in situ polymerization method. Conventional developers are generally obtained by an attrition technique, that is breaking down of the pigment until the correct size is obtained. The aforementioned polymerization method permits excellent control over particle size and size distribution, which is not present with the attrition process. Moreover, in pigment based particles the color imparted by the ink is related to the color of the pigment. With the particles of this invention, the latex is dyed; and as dyes can be mixed, there is much greater control over the color of the developer than is usually achieved with pigments.

Additionally, as indicated herein the liquid developers of this invention may be used in any suitable conventional liquid development electrostatographic imaging system. Thus, for example, the liquid developers of this invention may be selected to develop conventional electrostatic latent images on xerographic, electrographic, and migration imaging (XDM); or other electrostatographic imaging members. In view of the flocculated nature of the charged marking particles in the developer of this invention, excellent transfer of deposited marking particle images to a receiving member may be affected with few (less than 20 percent) residual marking particles remaining on the original imaging surface. Thus, the liquid developers of the present invention may be utilized in the xerographic process, or in other electrostatographic imaging systems including among others, electrographic recording, electrostatic printing, facsimile printing, and the like. Accordingly, it should be appreciated that the description herein is applicable to liquid developers which may have utility in a variety of commercial embodiments.

The following examples are being supplied to further define specific embodiments of the present invention, it being noted that these exampes are intended to illustrate and not limit the scope of the present invention. Parts and percentages are by weight unless otherwise indicated.

EXAMPLE I

A three-neck flask equipped with a stirrer, a condenser and a dropping funnel was charged with 6.25 grams of Elvax 420, which is a copolymer of poly(ethylene-co-vinyl acetate) (solubility temperature exceeds 40° C.) where the vinyl acetate content is approximately 18 mole percent, and 400 grams of Isopar G. The mixture was heated to 85° C. under a nitrogen blanket to dissolve the Elvax resin in the Isopar. Upon obtaining a homogeneous solution, 4 grams of benzoyl peroxide was added to the solution at 85° C., and 30 minutes later there was added dropwise 110 grams of vinyl acetate, which was added dropwise over a period of 5 minutes. The polymerization was allowed to proceed for approximately 16 hours at which time a further 0.1 gram of benzoyl peroxide was added to the resulting dispersion, and polymerization was continued for a further 4 hours. The solids content of the resulting latex was 23 percent by weight, and the particle diameter in the dispersed state was 0.6 micron as measured with a Brookhaven BI-90 light scattering instrument.

Subsequently, 108 grams of the latex was then added to 600 grams of Isopar G that had been heated to 65° C.; and 20 grams of methanol ws then added to this dispersion under constant stirring. Thereafter, 24 grams of Orasol Blue 2GLN was dissolved in 180 grams of methanol, the solution filtered through a Whatman #4 filter paper, and the solution added to the aforementioned latex dispersion which was maintained at 65° C. The aforementioned composition was then heated and stirred for 3 hours at which time the methanol was removed under a reduced pressure of 2 Torr, and the dispersion was filtered and stored in a plastic bottle. The resulting ink concentrate contained 8 percent by weight of particles. Upon cooling, the dispersion flocculated but could be readily redispersed by shaking. The floc size was estimated to be about 5 microns by light microscopy.

A ink was prepared from the concentrate by adding 417 grams of the above prepared mixture to 1,890 grams of Isopar L. To this dispersion was added 4.6 grams of a 10 weight percent lecithin/Isopar G mixture. After equilibrating for at least 24 hours, a negatively charged ink was obtained which had a charge/mass ratio of 100 microcoulombs per gram. The formed liquid developer was then placed in the developer housing of a Savin 780 liquid copier apparatus. A selenium photoreceptor, which develops a contrast potential of 800 to 1,000 volts, was used in this copier. Subsequent to the formation, development and heat fusing, cyan images of optical density of 1.2 were obtained, which images exhibited a resolution of 8 line pairs/millimeter (lp/mm). The transfer efficiency of the ink was measured gravimetrically by ceasing operation of the copier after toning the photoreceptor, allowing the toned images to dry, and measuring the weight of a dry toner image lifted from the photoreceptor with an adhesive tape. This was repeated on a subsequent image after transfer to plain paper was accomplished. The weight of the image on the photoreceptor minus the weight of the residual image after transfer was then divided by the weight of the dry image on the photoreceptor yielding the transfer efficiency of the ink. With this ink, the transfer efficiency was found to be 84 percent.

EXAMPLE II

Twelve and one half (12.5) grams of Elvax 230W (solubility temperature exceeds 40° C.), which is a poly(ethylene-co-vinyl acetate) copolymer containing 28 mole percent vinyl acetate, was dissolved in 400 grams of Isopar G at 70° C. under a nitrogen blanket. Subsequently, 4 grams of azobisisobutyronitrile (AIBN) was added to the formed solution followed 30 minutes later by the dropwise addition of 110 grams of N-vinyl-2-pyrrolidone over a period of 5 minutes. The polymerization was allowed to proceed for approximately 10 hours after which time a further 0.5 gram of AIBN initiator was added to the reaction medium, and the polymerization was allowed to proceed for a further 3 hours. A latex with a solids content of 24 weight percent was obtained. The particle diameter of the latex was found to be 0.4 micron with a Brookhaven BI-90 light scattering apparatus. Thereafter, 245 grams of the latex was added to 700 grams of Isopar G that had been heated to 65° C., followed by the addition of 10 grams of methanol. After filtering a solution of 21 grams of Orasol 2GLN dissolved in 160 grams of methanol, this solution was added to the dispersion. The system was kept at 65° C., and stirred constantly for 3 hours after which time the methanol was removed under a reduced pressure of 2 Torr, the dispersion filtered and stored in a plastic bottle. An ink concentrate containing 9 weight percent solids was obtained. Upon cooling, the dispersion flocculated but could be readily redispersed by shaking. The floc size was about 3 to about 5 microns as determined by light microscopy.

A ink was prepared by diluting 336 grams of the above prepared ink concentrate with 1,975 grams of Isopar L. To this dispersion was added 4.1 grams of a 10 weight percent solution of lecithin in Isopar G. After equilibrating for 24 hours, a negatively charged ink was obtained with a charge/mass ratio of 150 microcoulombs per gram.

The prepared liquid developer was then placed in the development housing of the Savin 780 liquid copier fitted with a selenium photoreceptor. Upon imaging with the image being heat fused, cyan images of an optical density of 1.2 were obtained. The resolution of the images on paper was 8 lp/millimeter. The transfer efficiency of the ink as determined by the process of Example I was 88 percent.

EXAMPLE III

A latex was produced by repeating the procedure of Example II with the exception that the comonomers N-vinyl-2-pyrrolidone and vinyl acetate were used in place of the N-vinyl-2-pyrrolidone alone. The proportion of N-vinyl-2-pyrrolidone to vinyl acetate was 2:1 by weight. A latex with a poly(N-vinyl-2-pyrrolidone-co-vinyl acetate) core was obtained with a particle size, as measured by light scattering, of 0.5 micron. The latex was dyed in an identical manner to that detailed in Example II with Orasol Blue 2GLN dye. The latex was then diluted and charged with lecithin. A negatively charged ink was obtained, which when imaged in the Savin 780 copier exhibited an optical density of 1.1, and a transfer efficiency from the photoreceptor to paper of 86 percent.

EXAMPLE IV

A latex was produced by repeating the procedure of Example II with the exception that Elvax 4320, which is a poly[ethylene-co-vinyl acetate-co-acrylic acid]terpolymer containing 24 mole percent vinyl acetate, was substituted for Elvax 230W. The particle diameter of the latex was 0.5 micron. This latex was dyed and charged as detailed in Example II. A negatively charged ink was obtained which when imaged in a Savin 780 liquid copier yielded cyan images of an optical density of 1.1. The transfer efficiency of this ink was 82 percent.

EXAMPLE V

The dyed latex obtained in Example IV was electrostatically charged with OLOA 1200 instead of lecithin. This was accomplished by diluting 100 grams of the dyed latex with 475 grams of Isopar G to which was added 0.4 gram of OLOA 1200. A stable negative ink was obtained which when imaged in the Savin 780 copier produced images of optical density 1.1, and exhibited a transfer efficiency of 84 percent.

EXAMPLE VI

The latex produced in Example I was dyed using Astrophalozine FF, which is a magenta dye obtained from Nachem Inc., instead of Orasol 2GLN. The dyeing step was accomplished by the procedure detailed in Example I. Thereafter, 18.75 grams of this ink concentrate was diluted with 81.25 grams of Isopar G and 0.065 gram of OLOA 1200 was added to the dispersion. After equilibrating for 24 hours, a positively charged ink was obtained, which produced magenta copies of optical densities 1.1 in the Savin 780 copier when imaging was affected in a reversal development mode. The transfer efficiency of the ink was found to be 81 percent.

EXAMPLE VII

The ink concentrate, 18.75 grams, described in Example VI was diluted with 81.25 grams of Isopar G and 0.05 gram of a 12 weight percent solution of zirconium octoate was added thereto as the charge control agent. A positively charged ink was obtained which produced magenta images of optical densit 1.0 in the Savin 780 copier when imaging was accomplished in a reversal development mode. The transfer efficiency of the ink was 82 percent.

Other modifications of the present invention will occur to those skilled in the art subsequent to a review of the present application. These modifications, and equivalents thereof are intended to be included within the scope of this invention.

We claim:

1. A liquid developer composition comprised of an oil base, dyed polymer particles, charge control additives, and stabilizers that enable the flocculation of the composition, which stabilizers possess a solubility temperature equal to or exceeding 40° C., and wherein said stabilizers are irreversibly physically or chemically attached to said dyed polymer particles.

2. An improved developer composition in accordance with claim 1 wherein the oil base is selected from the group consisting of Isopar G, Isopar H, Isopar L, and Isopar M.

3. A developer composition in accordance with claim 1 wherein the dye for the polymer particles is selected from the group consisting of cyan, magenta, and yellow dyes; and mixtures thereof.

4. A developer composition in accordance with claim 1 wherein the polymer is selected from the group consisting of poly(N-vinyl-2-pyrrolidone), poly(vinyl acetate), and poly(ethyl acrylate); and copolymers thereof.

5. A developer composition in accordance with claim 1 wherein the charge control additive is selected from the group consisting of polyisobutylene succinimide, lecithin, and zirconium octoate.

6. A developer composition in accordance with claim 1 wherein the stabilizer is a poly(ethylene-co-vinyl acetate) copolymer.

7. A developer composition in accordance with claim 1 with an image transfer efficiency of from 80 percent to about 99 percent.

8. A developer composition in accordance with claim 1 wherein the average diameter of the ink composition is from about 0.1 micron to about 1 micron.

9. A developer composition in accordance with claim 1 wherein the oil based vehicle is present in an amount of from about 90 to about 99.5 percent by weight.

10. A developer composition in accordance with claim 1 wherein the dyed polymer particles are present in an amount of from about 0.5 percent by weight to about 6 percent by weight.

11. A developer composition in accordance with claim 1 wherein the dye selected for the polymer particles is selected from the group consisting of Orasol Blue GN, Orasol Red 2BL, Orasol Blue BLN, Orasol Black GN, Orasol Black RL, Orasol Yellow 2RLN, Orasol Red 2B, Orasol Blue 2GLN, Orasol Yellow 2GLN, Orasol Red G, Morfast Blue 100, Morfast Red 101, Morfast Red 104, Morfast Yellow 102, Morfast Black 101, Savinyl Yellow RLS, Savinyl Yellow 2RLS, Savinyl Pink 6BLS, Savinyl Red 3BLS, Savinyl Red GL5, Savinyl Black RLS, Neozapon Black X57, and Astrophalozine FF.

12. A developer composition in accordance with claim 1 wherein the charge control additive is present in an amount of from about 0.01 percent by weight to about 2 percent by weight.

13. A method of imaging which comprises the formation of an image on an imaging member, subsequently developing this image with the composition of claim 1, thereafter transferring the image to a suitable substrate, and permanently affixing the image thereto.

14. A method in accordance with claim 13 wherein the image transfer efficiency is from about 80 to about 99 percent.

15. A method in accordance with claim 13 wherein there is formulated an electrostatic latent image.

16. A method in accordance with claim 13 wherein there is selected for the developer composition an oil base selected from the group consisting of Isopar G, Isopar H, Isopar L, and Isopar M.

17. A method in accordance with claim 13 wherein the polymer is selected from the group consisting of poly(N-vinyl-2-pyrrolidone), poly(vinyl acetate), and poly(ethyl acrylate); and copolymers thereof.

18. A method in accordance with claim 13 wherein the charge control additive is selected from the group consisting of polyisobutylene succinimide, lecithin, and zirconium octoate.

19. A method in accordance with claim 13 wherein the stabilizer is a poly(ethylene-co-vinyl acetate) copolymer.

20. A method in accordance with claim 13 with an image transfer efficiency of from 80 percent to about 99 percent.

21. A method in accordance with claim 13 wherein the average diameter of the ink composition is from about 0.1 micron to about 1 micron.

22. A method in accordance with claim 13 wherein the oil based vehicle is present in an amount of from about 90 to about 99.5 percent by weight.

23. A method in accordance with claim 13 wherein the dyed polymer particles are present in an amount of from about 0.5 percent by weight to about 4 percent by weight.

24. A method in accordance with claim 13 wherein the dye selected for the polymer particles is selected from the group consisting of Orasol Blue GN, Orasol Red 2BL, Orasol Blue BLN, Orasol Black GN, Orasol Black RL, Orasol Yellow 2RLN, Orasol Red 2B, Orasol Blue 2GLN, Orasol Yellow 2GLN, Orasol Red G, Morfast Blue 100, Morfast Red 101, Morfast Red 104, Morfast Yellow 102, Morfast Black 101, Savinyl Yellow RLS, Savinyl Yellow 2RLS, Savinyl Pink 6BLS, Savinyl Red 3BLS, Savinyl Red GL5, Savinyl Black RLS, Neozapon Black X57, and Astrophalozine FF.

25. A method in accordance with claim 13 wherein the charge control additive is present in an amount of from about 0.01 percent by weight to about 2 percent by weight.

26. A developer composition in accordance with claim 1 wherein the average particle diameter of the composition particles is from about 2 to about 8 microns.

27. A developer composition in accordance with claim 1 wherein the stabilizer is a poly[ethylene-co-vinyl acetate-co-acrylic acid]terpolymer.

28. A developer composition in accordance with claim 1 wherein the stabilizer solubility temperature is from about 40° to about 60° C.

29. A method in accordance with claim 13 wherein the stabilizer solubility temperature is from about 40° to about 60° C.

* * * * *